US006079298A

United States Patent [19]

Gasperi et al.

[11] Patent Number: 6,079,298

[45] Date of Patent: Jun. 27, 2000

[54] ERGONOMIC HANDLE AND DRIVER INCORPORATING SAME

[75] Inventors: Nancy C. Rittmann Gasperi, Racine; Steven R. Wente, Kenosha, both of Wis.

[73] Assignee: Snap-on Tools Company, Kenosha, Wis.

[21] Appl. No.: 09/040,708

[22] Filed: Mar. 18, 1998

[51] Int. Cl.[7] ..... B25B 13/46

[52] U.S. Cl. ..... 81/63.1; 81/60; 81/177.1; 81/489; D8/25; D8/107

[58] Field of Search ..... 81/58, 59.1, 60, 81/61, 62, 63, 63.1, 63.2, 177.1, 177.5, 489; D8/25, 40, 107, 300, 310, DIG. 2; 16/118, 121; D22/140, 141

[56] References Cited

U.S. PATENT DOCUMENTS

| | | | |
|---|---|---|---|
| D. 104,502 | 5/1937 | Overmyer | D8/DIG. 2 |
| D. 255,979 | 7/1980 | Boursaw . | |
| D. 271,937 | 12/1983 | Combs . | |
| D. 292,771 | 11/1987 | Kim . | |
| D. 299,612 | 1/1989 | Bradley . | |
| D. 337,246 | 7/1993 | Arden . | |
| D. 347,983 | 6/1994 | Lee . | |
| D. 359,211 | 6/1995 | Knox et al. | D8/25 |
| D. 371,298 | 7/1996 | Reddy et al. . | |
| D. 377,444 | 1/1997 | Lin | D8/107 |
| D. 378,797 | 4/1997 | Poremba et al. | D8/107 |
| D. 394,794 | 6/1998 | Vasudeva | D8/107 |
| D. 396,180 | 7/1998 | Burns et al. | D8/310 |
| 1,155,268 | 9/1915 | Pettigrove . | |
| 2,454,927 | 11/1948 | Kalwo . | |
| 3,742,787 | 7/1973 | Whiteford . | |
| 3,958,469 | 5/1976 | Meese . | |
| 4,086,831 | 5/1978 | Smith . | |
| 4,285,375 | 8/1981 | Judson . | |
| 4,466,523 | 8/1984 | De Carolis et al. . | |
| 4,597,478 | 7/1986 | Bodnar . | |
| 4,702,129 | 10/1987 | Allen . | |
| 4,783,884 | 11/1988 | Stricker et al. | 16/121 |
| 5,069,091 | 12/1991 | Bramsiepe et al. . | |
| 5,461,950 | 10/1995 | Iwinski . | |
| 5,528,963 | 6/1996 | Wei . | |
| 5,662,174 | 9/1997 | Vermilyer . | |

OTHER PUBLICATIONS

Snap–on Tools Catalog, p. 63, showing Model F714 Palm Style Ratchet Drive *no date*.

*Primary Examiner*—David A. Scherbel
*Assistant Examiner*—Joni B. Danganan
*Attorney, Agent, or Firm*—Seyfarth, Shaw, Fairweather & Geraldson

[57] ABSTRACT

A palm driver has a rotatable drive member and an ergonomic handle body connected to the drive member through a ratchet mechanism and covered by a cushioning grip. The handle body is asymmetrically curved and is substantially continuously convex along portions engageable in use with the user's hand, having a generally flattened top surface opposite the drive member and receivable in the user's palm, and a peripheral side surface which has a plan outline which is continuously convex and has a generally flattened heel portion and an opposed, much smaller radius finger portion, respectively engageable with the heel and fingers of the user's hand in use.

18 Claims, 2 Drawing Sheets

ERGONOMIC HANDLE AND DRIVER INCORPORATING SAME

BACKGROUND OF THE INVENTION

The present invention relates to handles for hand-operated devices, including driver tools such as screwdrivers, nut drivers, ratchets and the like. The invention relates in particular to handles of the type which are adapted to be disposed in use against the palm of a user's hand.

Palm-type drivers, both ratcheting and non-ratcheting, have previously been provided. Such drivers generally include a drive member having an axis of rotation and adapted to be engaged with an associated driven member, such as a fastener or the like, for rotating it. The drive member is coupled to a handle which is adapted to be received, in use, in the palm of a user's hand. Such handles have heretofore taken a number of different shapes. One standard type of tool has an elongated handle which crosses the axis of the drive member to define a generally T-shaped tool. Other handles have been generally spherical or part-spherical, and have been provided with and without flutes or recesses for receiving the fingers of a user's hand in use.

While such prior handle shapes have functioned acceptably, they have generally been uncomfortable, particularly in cases of extended use. The T-shaped tools do not fit easily into a user's palm and, while part-spherical handles generally fit better in the palm of the hand, they afford less leverage.

SUMMARY OF THE INVENTION

It is a general object of the invention to provide an improved handle which avoids the disadvantages of prior handles while affording additional structural and operating advantages.

An important feature of the invention is the provision of a handle which is ergonomically shaped so as to afford improved comfort in use without sacrificing leverage.

In connection with the foregoing feature, another feature of the invention is to provide a cushioned handle of the type set forth.

Still another feature of the invention is the provision of a driver incorporating a handle of the type set forth which is of simple and economical construction.

Certain ones of these and other features of the invention may be attained by providing a palm-engaging handle for a device comprising: a handle body having a first side adapted to be coupled to an associated device and an opposed convex generally flattened second side adapted to be received in the palm of a user's hand in a use position, the handle body including a peripheral wall extending between the first and second sides and having a generally flattened heel portion disposed for engagement with the heel of a user's hand in the use position and an opposed arcuately convex finger portion around which a user's fingers wrap in the use position and convex side portions joining the heel portion and the finger portion.

Other features of the invention may be attained by providing a driver incorporating such a handle.

Still other features may be attained by providing a palm driver comprising: a rotatable drive member having an axis of rotation, and a handle body coupled to the drive member with the axis extending substantially centrally through the body, the body having a thickness along the axis and a width and a length measured in directions substantially perpendicular to each other and to the axis, wherein the width is substantially greater than the thickness and substantially less than the length, the intersection of the body with a central plane perpendicular to the axis having an outline which defines a continuously convex curve.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
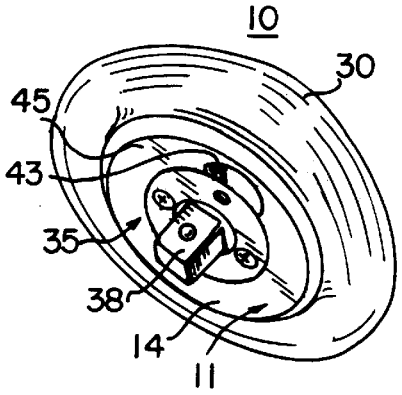
FIG. 1 is a bottom perspective view of a palm driver constructed in accordance with and embodying the features of the present invention.
Figure 2:
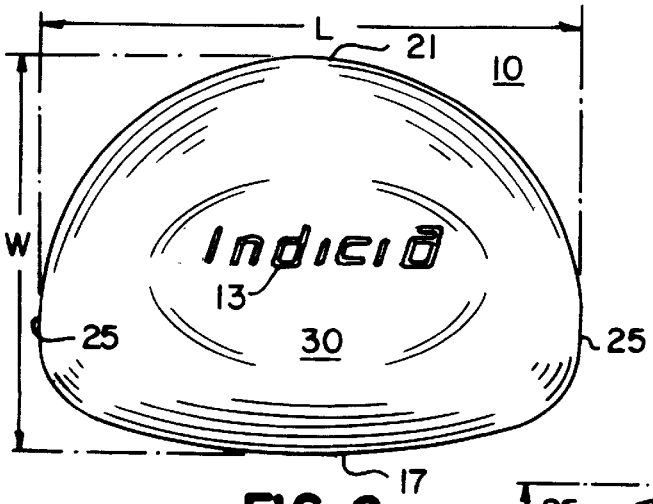
FIG. 2 is an enlarged top plan view of the driver of FIG. 1.
Figure 4:
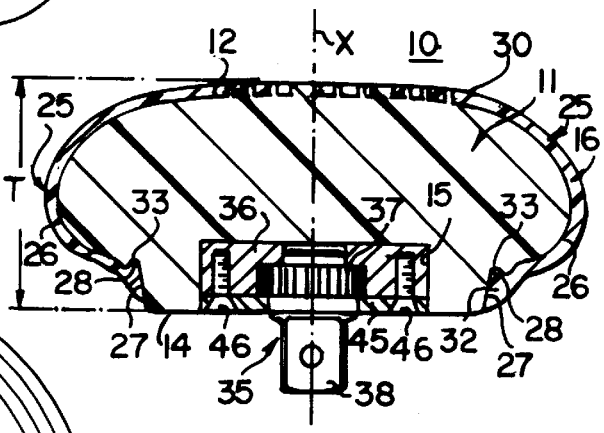
FIG. 4 is a view in vertical section taken generally along the line 4—4 in FIG. 3.
Figure 3:
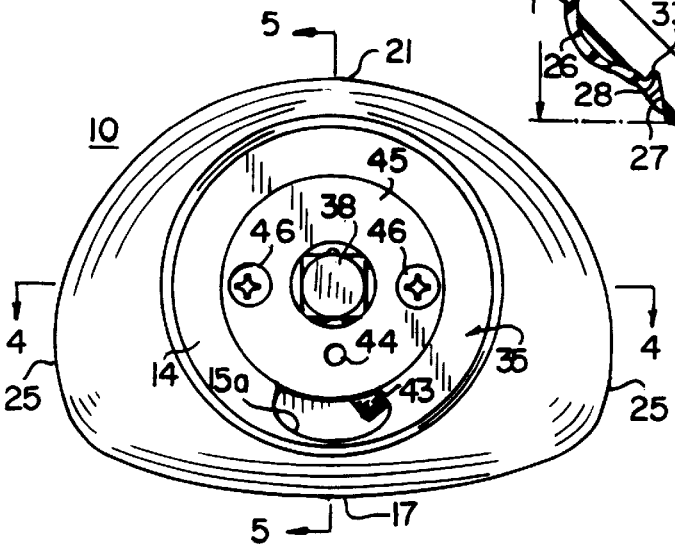
FIG. 3 is a bottom plan view of the driver of FIG. 2.
Figure 5:
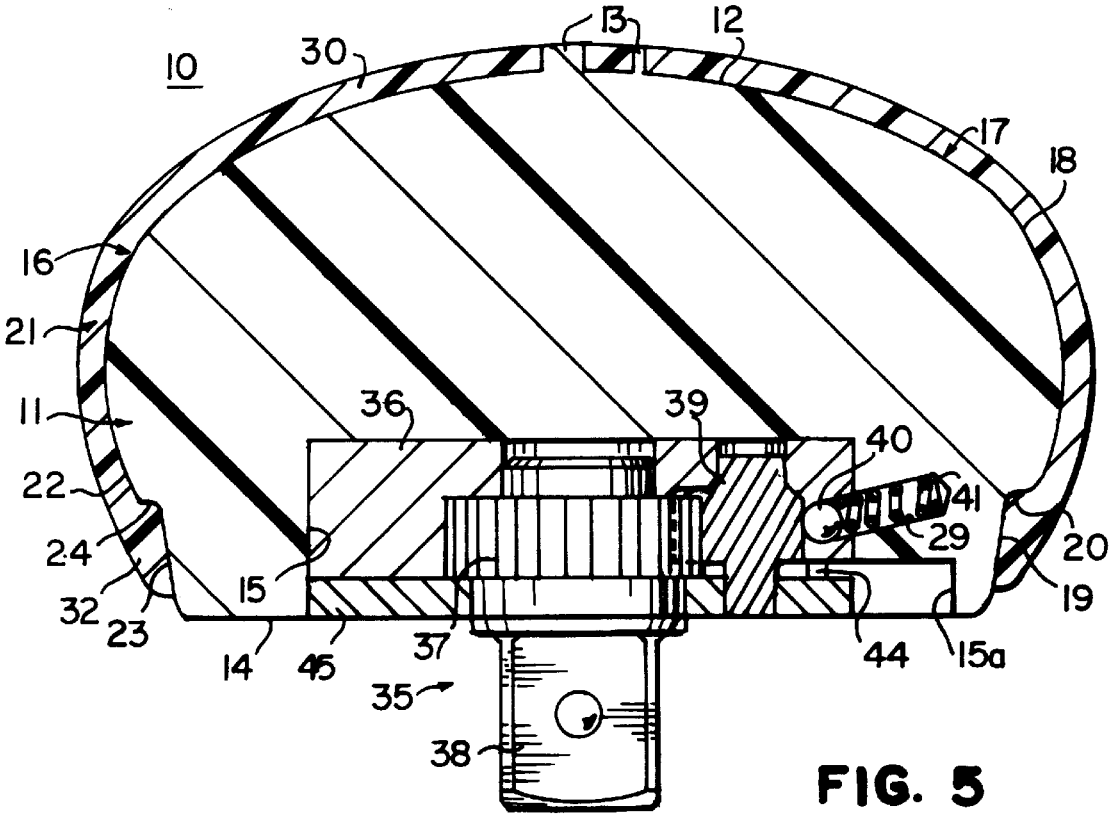
FIG. 5 is a further enlarged view in vertical section taken along the line 5—5 in FIG. 3.

Referring to FIGS. 1–5, there is illustrated a palm driver generally designated by the numeral 10, constructed in accordance with the present invention. The driver 10 has a handle body 11, preferably formed of a suitable plastic material and having a generally flattened and asymmetrically curved shape. The body has a generally flattened, slightly convex top surface 12 of a relatively large radius, which may be provided with raised indicia 13 projecting upwardly therefrom. Opposite the top surface 12 is a substantially annular flat, planar bottom surface 14 which surrounds a generally cylindrical recess 15 having an arcuate lobe 15*a* projecting generally radially from one side thereof (FIGS. 3 and 5). The top and bottom surfaces 12 and 14 are joined by a curved peripheral wall 16, which has a continuously convex plan outline (FIGS. 2 and 3). The peripheral wall 16 has a generally flattened convex heel portion 17 which intersects the section plane of FIG. 5 along an arcuate portion 18 and an inclined straight portion 19, joined by a radial shoulder 20 (see FIG. 5). The peripheral wall 16 also has a convex finger portion 21 opposite the heel portion 17 which, in the cross section of FIG. 5, has an arcuate portion 22 and a straight inclined portion 23 joined by a generally radially extending shoulder 24.

The peripheral wall 16 also has side portions 25, each of which intersects the section plane of FIG. 4 along a small radius arcuate portion 26 which leads into an undercut sloping surface 26*a* which is, in turn, joined to an inclined straight portion 27 by a groove or recess 28. Thus, it can be appreciated that, around the periphery thereof, the peripheral wall 16 continuously changes shape, both in plan outline and in vertical cross sectional outline. In particular, the handle body 11 has a thickness T, which is the maximum distance between the top and bottom surfaces 12 and 14 (FIG. 4) (including the raised indicia 13), a width W, which is the maximum distance between the heel portion 17 and the finger portion 21 in plan outline, and a length L, which is the maximum distance between the side portions 25 in plan outline (FIG. 2). Overall, the handle body 11 has a generally flattened oblong shape, wherein the width W is substantially greater than the thickness T and substantially less than the length L. In a preferred embodiment the ratio W/T is greater than 1.5 and the ratio L/W is greater than 1.2. While the heel portion 17 is convex, it has a relatively large radius so as to be substantially flattened in appearance, while the opposed finger portion 21 has a much smaller radius. Preferably, the radius of the finger portion 21 is substantially less than half of the radius of the heel portion 17.

Referring in particular to FIG. 5, the handle body 11 is also provided with a cylindrical, inclined socket 29 (FIG. 5) which communicates with the recess 15 and projects generally radially therefrom, being inclined slightly to the plane of the bottom surface 14 and positioned generally centrally of the lobe 15*a*.

It is a significant aspect of the invention that the handle body is provided with a cushioning grip in the form of a sheath 30 of a suitable elastomeric material, such as Santoprene, to provide increased comfort and improved grip. More specifically the sheath 30 substantially covers nearly the entirety of the handle body 11 except for the bottom surface 14. Preferably, the sheath 30 is of substantially uniform thickness over most of its area, this thickness being substantially equal to the height of the raised indicia 13 (if any), so that the tops of those indicia are exposed. The sheath 30 has increased-thickness flanges 32 which extend along the inclined portions 19, 23 and 27 of the peripheral wall 16 and along the shoulders 20 and 24, and is provided with lips 33 which fit up into the grooves 28 (FIG. 4). The sheath 30 may be molded over the handle body 11 or, alternatively, could be secured in place by a suitable adhesive.

In the illustrated embodiment, the driver 10 is a ratchet driver and includes a ratchet mechanism 35 (FIGS. 3–5). The ratchet mechanism 35 includes a generally annular bushing 36 which is seated in the recess 15 and receives therein a ratchet gear 37, including a drive lug 38 which projects downwardly beyond the bottom surface 14. The ratchet gear 37 has an axis of rotation X (FIG. 4) which extends substantially centrally through the handle body 11 and, more particularly, through the top and bottom surfaces 12 and 14 thereof. The ratchet mechanism 35 also includes a pawl 39 which is rotatably seated in an eccentric bore in the bushing 36 for ratcheting engagement with the ratchet gear 37 in a known manner. A ball 40 is resiliently urged into engagement with the pawl 39 by a spring 41 seated in the socket 29. The pawl 39 is engaged by a reversing lever 43, which rotates about the axis of a pivot pin 44 to shift the position of the pawl 39 between forward and reverse ratcheting positions, being resiliently retained in each of these positions by the ball 40, all in a well-known manner. The parts are retained in place in the recess 15 by a cover plate 45, which may be secured by suitable screws 46.

Figure 6:
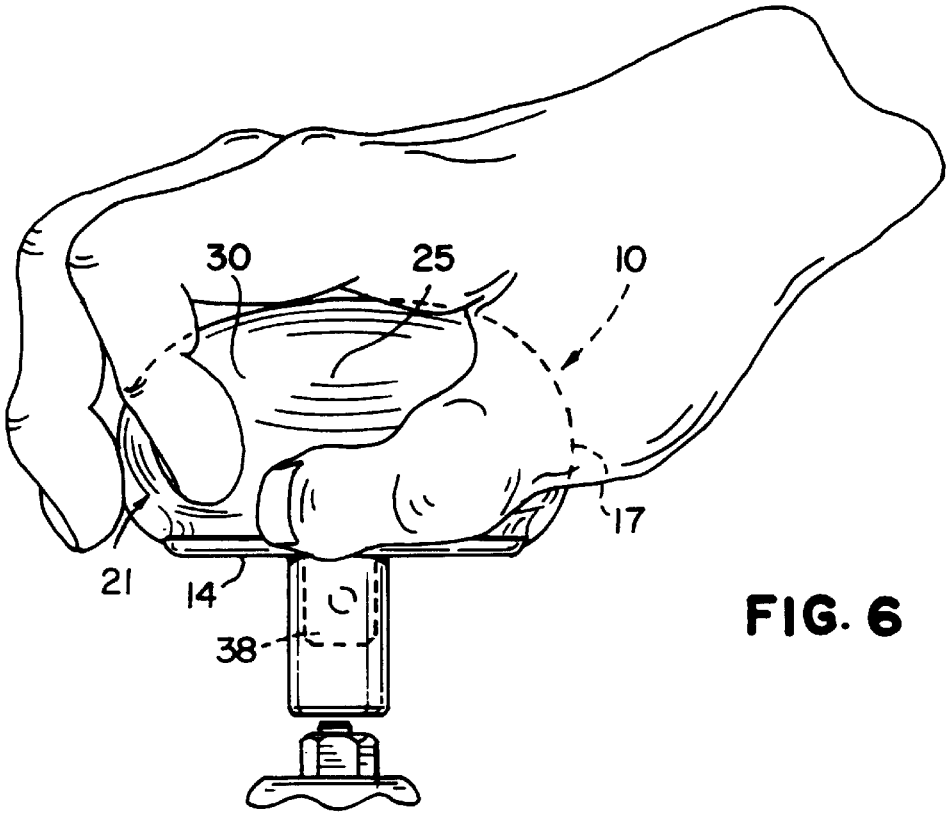
FIG. 6 is an enlarged, side elevational view of the driver of FIG. 1 illustrating its cooperation with a user's hand.

Referring now to FIG. 6, in use the handle body 11 is designed for comfortable gripping by a user's hand. More specifically, the top surface 12 is shaped to fit generally into the palm of the user's hand or partially under the junction between the fingers and the palm, with the heel of the hand engaging the heel portion 17 and the fingers wrapped around the finger portion 21. The smooth, continuously convexly curved shape of the handle body 11 affords a comfortable, non-pinching grip by the user, the comfort and resistance to slipping being increased by the cushioning frictional sheath 30. The substantial width W of the body 11 provides for comfortable grasping of the body 11, while maintaining the top surface 12 in contact with the palm of the hand. The oblong shape of the body 11, afforded by the length L being substantially greater than the width W, permits improved leverage. The generally flattened and relatively thin shape of the handle body 11, afforded by the thickness T being substantially less than the width W, permits the user's fingers to wrap beneath the finger portion 21, and the side portions 25 form laterally extending, reduced thickness wings, so that the base of the user's thumb can hook beneath a side portion 25 against the portion 26*a* to provide substantially better gripping than with part-spherical bodies. The large curved area of the finger portion 21 provides a large area of contact with the user's fingers to afford a wide distribution of forces among the fingers.

While, in the illustrated embodiment, the driver 10 is a ratchet driver, it will be appreciated that the principles of the present invention are equally applicable to non-ratcheting drivers. Also, the handle body 11 could be used with other devices, such as manual transmission shift levers, for example.

Furthermore, while specific shapes and materials have been described, it will be appreciated that other materials and slight variations in shape could be utilized while still achieving the advantages of the present invention.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A palm-engaging handle for a rotatable device comprising:

a handle body having a first side and an opposed slightly convex second side adapted to be received in the palm of a user's hand in a use position, said first side being adapted to be coupled to an associated device along an axis of rotation extending substantially centrally through said first and second sides, said handle body including a peripheral wall extending between said first and second sides and having a generally flattened heel portion disposed for engagement with the heel of a user's hand in the use position and an opposed arcuately convex finger portion around which a user's fingers wrap in the use position and convex side portions joining said heel portion and said finger portion, the plan outline of said body perpendicular to the axis defining a continuously convex curve, said body having an axial extent substantially less than its extent in any direction perpendicular to the axis.

2. The handle of claim 1, wherein said first side has a substantially planar external surface.

3. The handle of claim 1, and further comprising a cushioning grip substantially covering said handle body.

4. The handle of claim 3, wherein said peripheral wall has recesses formed therein, said grip being received in said recesses.

5. The handle of claim 1, wherein said handle body is formed of a plastic material.

6. A palm driver comprising:

a rotatable drive member having an axis of rotation, and a handle body coupled to the drive member with the axis extending substantially centrally through the body, said body having a thickness along said axis and a width and a length measured in directions substantially perpendicular to each other and to said axis, wherein the width is substantially greater than the thickness and substantially less than the length, the plan outline of said body perpendicular to said axis defining a continuously convex curve.

7. The driver of claim 6, wherein said body has a smoothly curved non-angular shape.

8. The driver of claim 6, wherein the ratio of said width to said thickness is greater than about 1.5 and the ratio of said length to said width is greater than about 1.2.

9. The driver of claim 6, wherein said thickness is defined between axially opposed sides of said body, each of which is generally flattened.

10. The driver of claim 6, wherein said body has an outer surface, and further comprising a cushioning grip member substantially covering said outer surface.

11. The driver of claim 6, and further comprising a ratchet mechanism carried by said body and coupled to said drive member.

12. The driver of claim 6, wherein said body is formed of a plastic material.

13. The driver of claim 6, wherein said heel portion and said finger portion are arcuate with the radius of the finger portion being substantially less than half the radius of the heel portion.

14. A palm driver comprising:

a rotatable drive member having an axis of rotation, and a handle body coupled to the drive member, said handle body having a first side from which the drive member projects and an opposed slightly convexly curved second side adapted to be received in the palm of a user's hand in a use position, said handle body including a peripheral wall extending between said first and second sides and having a slightly convexly curved heel portion disposed for engagement with the heel of a user's hand in the use position and an opposed arcuately convex finger portion around which a user's fingers wrap in the use position and convex side portions joining said heel portion and said finger portion.

15. The driver of claim 14, wherein the plan outline of said peripheral wall perpendicular to said axis defines a continuously convex curve.

16. The driver of claim 15, wherein said heel portion and said finger portion are arcuate with the radius of the finger portion being substantially less than half the radius of the heel portion.

17. The driver of claim 14, and further comprising a ratchet mechanism carried by said body and coupled to said drive member.

18. The driver of claim 14, wherein said drive member includes a drive lug substantially polygonal in transverse cross section.

* * * * *